US005168784A

United States Patent [19]

Foster et al.

[11] Patent Number: 5,168,784

[45] Date of Patent: Dec. 8, 1992

[54] HYDRO-CUTTER

[75] Inventors: Clyde E. Foster; George R. Alcorn, both of Pasco, Wash.

[73] Assignee: Universal Frozen Foods, Inc., Twin Falls, Id.

[21] Appl. No.: 762,429

[22] Filed: Sep. 19, 1991

[51] Int. Cl.[5] ..... B26D 3/11

[52] U.S. Cl. ..... 83/24; 83/98; 83/402; 83/420; 83/932

[58] Field of Search ..... 83/24, 98, 402, 403.1, 83/732, 418, 420, 592, 863, 404.3

[56] References Cited

U.S. PATENT DOCUMENTS

| | | | |
|---|---|---|---|
| 2,787,273 | 4/1957 | Kerr | 99/491 X |
| 3,108,625 | 10/1963 | Lamb et al. | 83/402 |
| 3,109,468 | 11/1963 | Lamb et al. | 83/402 X |
| 3,361,173 | 1/1968 | Lamb | 83/98 X |
| 4,082,024 | 4/1978 | Hodges et al. | 83/402 |
| 4,423,652 | 1/1984 | Winslow | 83/98 X |
| 4,614,141 | 9/1986 | Mendenhall et al. | 83/402 |
| 4,644,838 | 2/1987 | Sampson et al. | 83/865 |
| 4,807,503 | 2/1989 | Mendenhall | 83/402 X |
| 4,926,726 | 5/1990 | Julian | 83/165 |
| 4,979,418 | 12/1990 | Covert et al. | 83/865 |
| 5,042,342 | 8/1991 | Julian | 83/98 |

FOREIGN PATENT DOCUMENTS 0377451 7/1990 European Pat. Off. .

*Primary Examiner*—Douglas D. Watts
*Assistant Examiner*—Rinaldi Rada
*Attorney, Agent, or Firm*—Foley & Lardner

[57] ABSTRACT

The present invention relates generally to a cutting system for vegetables, including potatoes, which includes a water system for moving the item to be cut along a tubular passageway and through a cutting mechanism. The system includes a water bypass arrangement which is controllable to provide a constant velocity so that the flow of product to the cutting knife is maintained at a desirable level. Alignment fingers may also be provided to prevent rotation of the uncut product and centering thereof as the cutting knife is approached. After the product is cut, the pieces pass into an outlet section where water from the bypass system may be injected to achieve, in the preferred embodiment, coil separation when the device is used for cutting helical strips of potatoes.

11 Claims, 3 Drawing Sheets

HYDRO-CUTTER

BACKGROUND OF THE INVENTION

1. Field of the Invention

The present invention relates generally to the art of cutting food products and more specifically to a device for cutting vegetables, such as potatoes, into desired shapes. Still more specifically, the present invention in its most preferred form relates to a system for cutting helical strips of potatoes and includes a water system for aligning and feeding potatoes through a cutting mechanism.

2. Description of the Prior Art

Many devices of differing designs have been described in the prior art for cutting various vegetable materials, including potatoes. Many of the devices described in the patent literature relate to devices for use at home or for the handling of individual food products. Simple examples of such systems would be found in most households, i.e. rotary food processors, vegetable slicers, etc.

The commercial cutting of potatoes into variously shaped pieces has also been known for a number of years. Frozen potatoes can be purchased in any grocery store in a variety of shapes, including the common shoestring shape (generally square in cross-section and having a length of 3–4 inches or longer), crinkle-cut potatoes which have a corrugated appearance, and in recent years, helical strips of potatoes which are of the type sold by the assignee of the present invention under the trademark CURLEY Q®.

The evolution of the helical potato is a phenomenon of the late 80's Somewhat similarly shaped products originated prior to that time from hand crank machines used at county fairs and in small restaurants. These early machines for making helical strips typically had a system for impaling the potato on a rotating, screw driven holder and rotating it into a fixed knife to produce helical strips. The product was typically uneven in consistency and the process was always slow. Moreover, the process typically resulted in inefficient use of the potato product, as the butt ends of the potato were not included in the final product and were discarded or used for other purposes.

It was not until the assignee of the present invention introduced the CURLEY Q® potatoes in 1983 that the cut variety became popular on a national basis. The reason for the increase in popularity was the improved product quality and the ability to commercially manufacture the product using the cutting device described in U.S. Pat. No. 4,644,838, issued Feb. 24, 1987 to Samson et al. and entitled "Apparatus for Helical Cutting of Potatoes". In this device, various conveyor systems are described for bringing product to a plurality of tubes. A potato is deposited in each tube and held therein against rotation by a plurality of spring-loaded, generally triangularly shaped fingers. A knife blade which includes a number of upstanding scoring blades and a radially extending cutting blade is located beneath the tube and is designed to be rotated during the cutting operation. The patent further describes a plunger system for exerting downwardly extending forces on the potato held in the tube to push the potato through the cutting knife, resulting in a plurality of helical strips of varying diameters, depending on the distance from the axis of the tube.

In the preferred embodiment of the Samson et al. patent, the bottom of the plunger includes recesses to receive the upstanding scoring knives so that the entire potato can be cut using the process, thereby avoiding prior difficulties and the waste resulting from butt ends. The knife itself is rotated by a motor and a belt, and a stationary tube receives the product. After being cut, separation of the various coils for improved product appearance takes place. Initially such separation was accomplished by hand. Later, mechanical coil separators were used for this part of the process.

Since the introduction of this product by the assignee of the present invention, numerous other frozen potato manufacturers have introduced similarly shaped products, some using different cutting technologies. Moreover, the assignee of the present invention has itself developed improvements, such as a "Cutting Assembly" described in U.S. patent application Ser. No. 07/682,653, filed Apr. 9, 1991, in the name of Foster. In this application, a tiered blade is used instead of the blade described in the Samson et al. patent. The blade is positioned to form concentric longitudinal cuts in the potato such that helical strips are produced in an efficient and reproducible manner.

Other patents have issued to competitors of the assignee on cutting knives and on production devices, such as the systems described in U.S. Pat. No. 4,926,726, issued May 22, 1990 to Julian and entitled "Food Processing Apparatus" and U.S. Pat. No. 4,979,418, issued Dec. 25, 1990 to Covert et al. and entitled "Food Processing Apparatus". In both patents, a rotating cutter head is used to produce helical strips from potato product forced through the knife using an elongate feed system including conveyors and spring biased paddle and spike members. The feed device is described as being very similar to the SC-120 Corn Cutter marketed by FMC Corporation to feed cob corn to a cutting assembly, which machine is described in detail in U.S. Pat. No. 2,787,273. The feed conveyor includes U-shaped areas for centering the potato, dogs to maintain product alignment and a spring loaded top plate floating on the top of the potatoes as they pass along the line. As the potatoes enter the area adjacent the rotating cutting head, they pass through a series of pairs of shafts extending across the path of travel, the first two shaft pairs including a plurality of paddles which urge the potatoes forwardly toward the knife, and the last pair of shafts including a plurality of spikes which grasp and penetrate the potato as it is being pushed through the cutting head. Each pair of shafts, one above and one below the feed path, is spring biased to compensate for different sized potatoes. The device can operate continuously with one potato following another through the system.

Water gun systems have also been known for some time in the potato processing field, i.e. systems which use a tube to align potatoes and water pressure to push the potatoes through the tube at increasing velocity and through knives of various types. Typically, such devices have been used for making straight cut potatoes, wherein fixed, crossed blades were mounted at the outlet of the water gun and the potatoes were merely forced therethrough at high speed.

One attempted use of a water-feed system for the preparation of helical cut french fries is described in European Patent Application No. 0 377 451, published Jul. 11, 1990 and filed by Lamb-Weston, Inc. An embodiment disclosed in this application shows a tubular, elastic tapered feed tube for feeding potatoes under the force of water pressure through a rotating cutting head to form helical potato strips. According to the application, the elastomeric member expands once the potato reaches the tapered end, thus decreasing the velocity of the potato, but increasing the water pressure to the range of 15–25 pounds per square inch. The applicant indicates that the potato is forced evenly and gently onto a central alignment tube and that the alignment tube also serves to decelerate the potato before the slicing blades cut the potato into helical strips. The specification also indicates that no external mechanical devices touch the potato, thus eliminating any damage to the outside of the potato.

It would represent a significant advance in this art to provide a water feed system in which potatoes could be forced through a cutting head to form cut product at a consistent velocity and on a continuous basis, without the need to raise and lower a plunger between each product cutting step. Therefore, a system which would produce a high quality product at increased speeds, and using less energy in the operation of the equipment, would represent a very substantial advance in the art.

SUMMARY OF THE INVENTION

The present invention provides advantages not heretofore described in the prior art known to applicants, including the principal advantage of being able to use a water feed system for the manufacture of a variety of cut vegetable products, including helical strips of potato products.

Another advantage of the present invention is the ability to precisely align and feed product into a cutting assembly, with the product following in a continuous flow without the need for an intermediate plunger withdrawal and loading step as was required in the aforementioned Samson et al. patent system.

A further advantage of the invention resides in the ability to control water flow in such a manner that delicate cuts can be made, and wherein the product flow can also be controlled to accommodate feed products of different sizes.

A still further advantage of the invention is the utilization of a water bypass arrangement to provide for the aforementioned water control, the return flow thereof being used to aid in separation of the cut product formed during the cutting operation.

Yet another advantage of the invention resides in its ability to be employed with a variety of cutting heads, including the head described in the aforementioned Samson et al. patent and the tiered blade described in the above-referenced pending application of Foster.

How these and other advantages of the invention are accomplished will be described in the following detailed description of the preferred embodiment, taken in conjunction with the FIGURES. Generally, however, the advantages are accomplished by providing a tapered receiving tube in which product, e.g. potatoes, is introduced with water from a pump such as a centrifugal food grade pump. As the product moves through the tube, the velocity thereof increases and the product will tend to align itself along the axis of the tube. The outlet end of the tube is coupled to a bypass flow control section, wherein the amount of water, and hence, the water pressure, is controlled by allowing a portion of the water to bypass the cutting assembly. In the illustrated and preferred embodiment, the bypass water re-enters the device in a decelerator section downstream of the cutting head and assists in separation of the product formed by the cutter. Also located in the bypass, flow-control section are a plurality of centering fingers which are pneumatically controlled to align product at the exit of the flow control section where the cutting head is located. The cutting assembly used in the illustrated embodiment of the present invention is the one described in the aforementioned Foster application.

Further ways in which the advantages described above are accomplished in the present invention will become readily apparent to one skilled in the art after the present specification has been read and understood. Such other ways are deemed to fall within the scope of the present invention, especially if they fall within the scope of the claims which follow.

DESCRIPTION OF THE DRAWINGS

In the various drawings, like reference numerals are used to denote like components.

DETAILED DESCRIPTION OF THE PREFERRED EMBODIMENT

Before proceeding to the detailed description of the preferred and illustrated embodiment, several comments need to be made about the applicability of the invention and the nature of the drawings and exemplary embodiments shown. First, the drawings illustrate the best mode known to us for manufacturing helical strips of potato products of the type sold by the assignee of the present invention. Such products are made typically from skin-on whole potatoes which have been washed and preheated as is generally known in this field. Second, the drawings illustrate a particular cutting mechanism as described in the above-referenced Foster application, a cutting knife we believe to be highly suitable for the helical fry cutting operation.

While potatoes and a particular cutting knife have been illustrated, the apparatus of the present invention has a wider applicability. For example, different cuts of potatoes could be made by changing the cutting knife (to another rotating or to a stationary knife) and foods other than potatoes could be used in lieu of the illustrated potatoes, i.e., other tubers, carrots, etc. These could be cut into helical strips or other shapes, again depending on the cutting knife employed.

Figure 1:
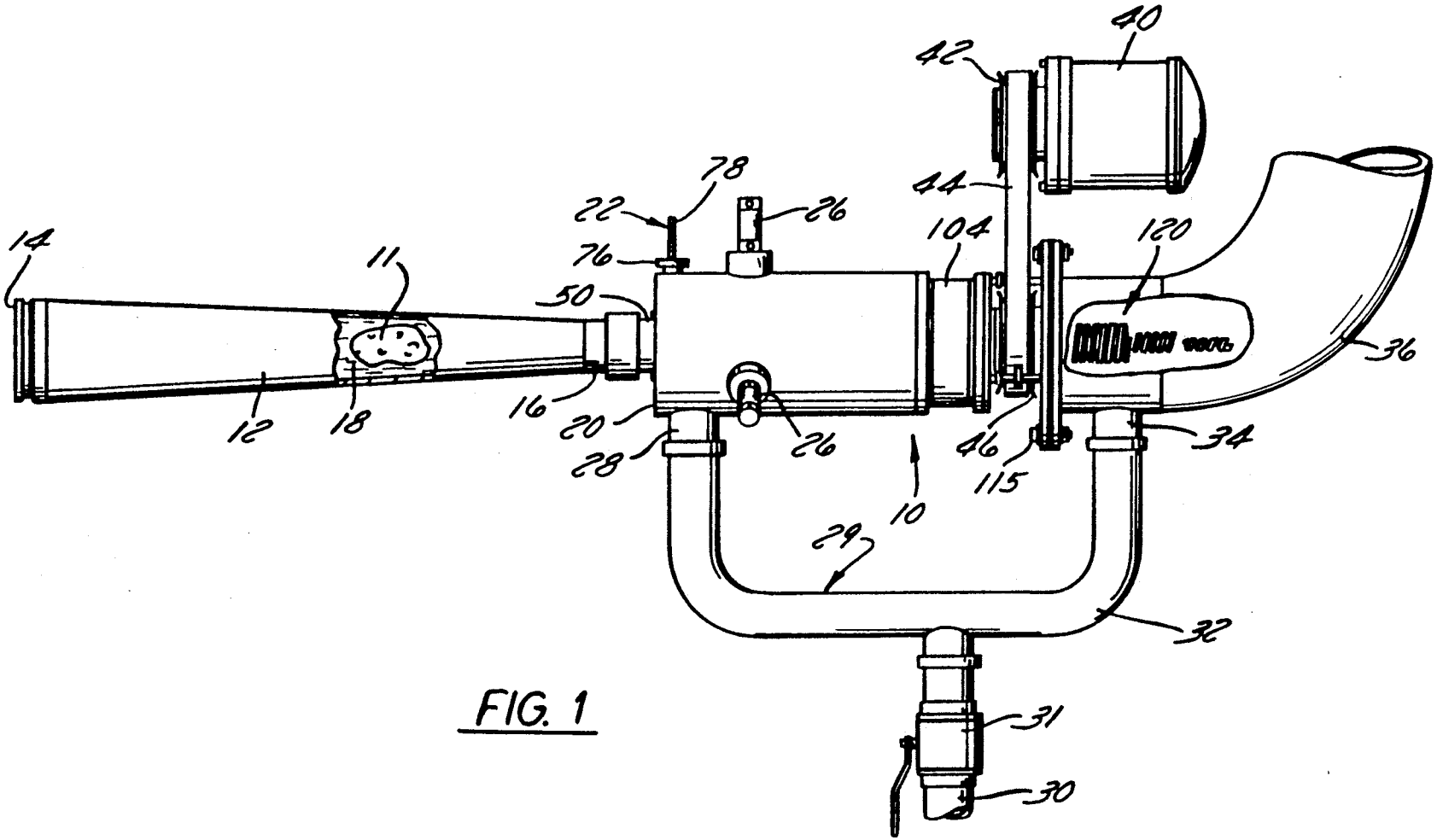
FIG. 1 is a schematic view, partially in section and partially in phantom, of the hydro-cutter of the preferred form of the present invention.
Figure 2:
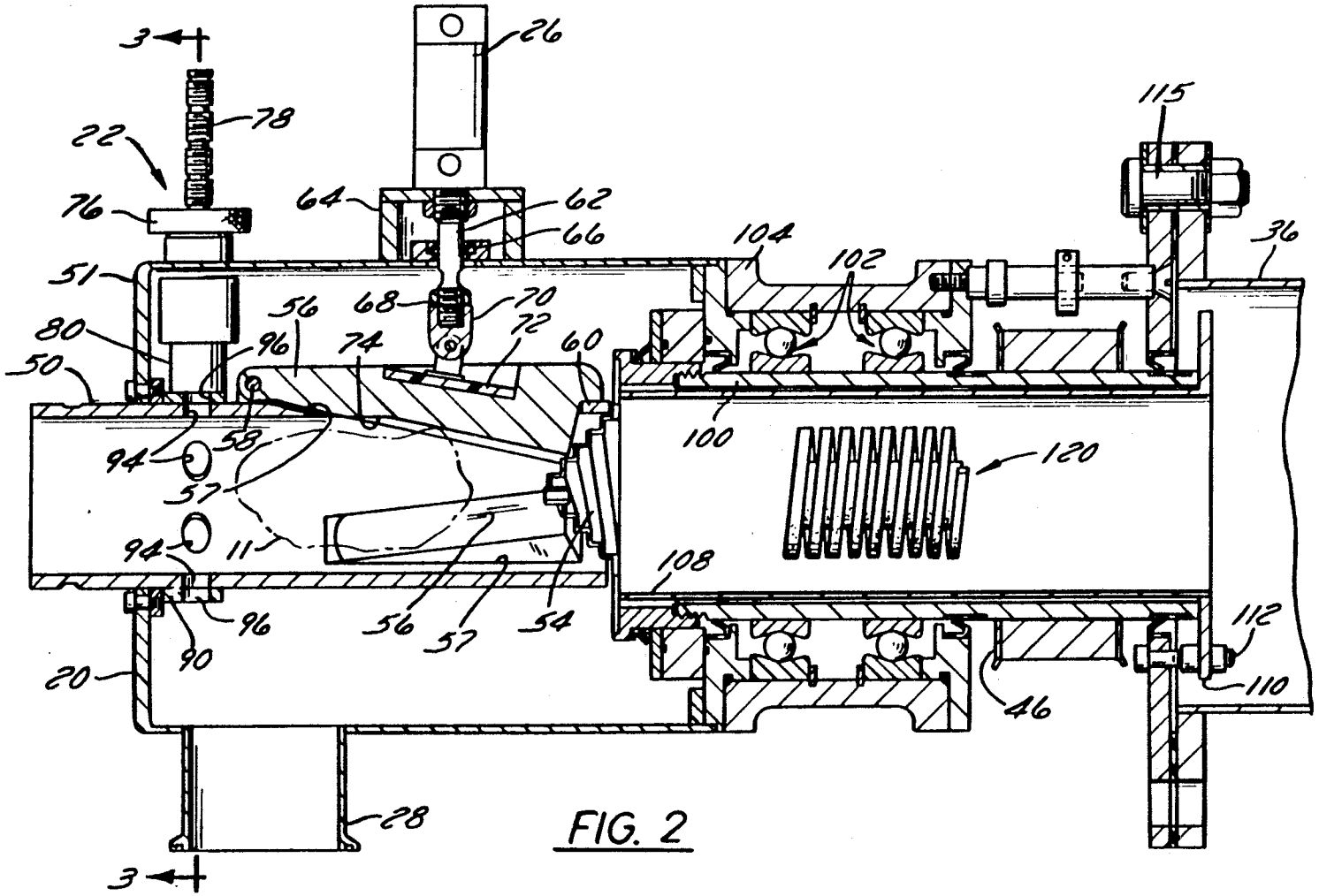
FIG. 2 is an exploded view of the flow control and cutting sections of the device shown in FIG. 1 and illustrating certain details of the motor driven knife.
Figure 3:
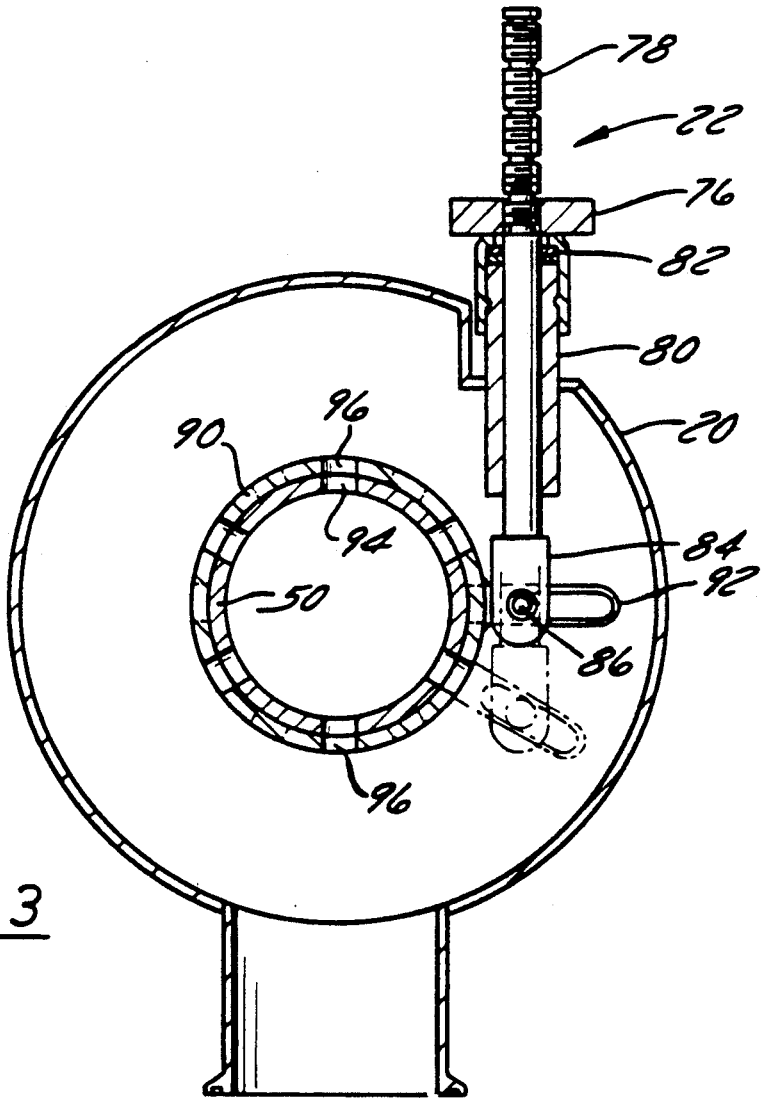
FIG. 3 is an end sectional view taken along the line 3—3 of FIG. 2 and showing further features of the water flow control and bypass components of the preferred embodiment of the present invention.

Furthermore, before proceeding to the description of FIGS. 1–3, it should be mentioned that the knife holding and rotating design illustrated is preferred, but others could be substituted, including those shown in the Samson et al. patent or in the Julian or Covert et al. patents referred to in the prior art section of this specification. The invention relates mainly to the system for locating the potato at the knife and feeding it therethrough, not to the ancillary components of rotating devices and upstream and downstream processing components. The exception to the latter point is the water bypass system, which is an important feature of the illustrated embodiment of the invention, both from the standpoint of potato feed and coil separation.

Proceeding now to the description of FIG. 1, a cutting assembly 10 is shown generally to include a circular, tapered and rigid feed tube 12 into which is fed a plurality of potatoes 11 to be cut by assembly 10. Tube 12 itself is of conventional design and has a gradually decreasing cross-section from the input end 14 to an output end 16. One potato 11 is shown in a broken-away section of FIG. 1. Water 18 is also present in tube 12 and is supplied from a pump 15. A food grade pump is required for food applications, and the water is fed to the inlet end 14 in a conventional manner along with the food product.

As is somewhat schematically illustrated in FIG. 1, the potato will typically have a longitudinal axis, and the product will tend to align itself as it passes from end 14 to end 16 of tube 12. It should also be mentioned at this point that the velocity of the product will increase as it moves toward the outlet end 16. Tube 12 will cause a jetting effect as the potatoes reach end 16, since the potatoes tend to "block" the tube and be forced therethrough by the constant volume of water fed upstream into the system. Obviously, the outlet end 16 of tube 12 must have an inside diameter in excess of the largest potatoes which will be processed by assembly 10.

Located at the outlet end of tube 12 is a flow control chamber 20, which is a generally cylindrical housing to be described in greater detail in connection with FIG. 2. In the schematic of FIG. 1, a flow control mechanism 22 is illustrated, as are the exterior components 26 of pneumatic alignment fingers also to be described later in the specification. A water outlet pipe 28 is shown extending radially from the bottom of chamber 20, outlet 28 being coupled to a pipe system 29 of generally U-shape. A water diversion or outlet "T" 30 is shown having a valve 31 therein, pipe 29 continuing to a return portion 32 coupled to an inlet 34 of another cylindrical chamber 36 formed downstream of the cutting components of cutter assembly 10.

Also shown in FIG. 1, in schematic form, is a drive motor 40 having a pulley 42 mounted on the shaft thereof and receiving a belt 44. Belt 44 is also coupled to a pulley 46 of a rotating cutter drive assembly to be described in connection with subsequent FIGURES. From the schematic, it can be generally appreciated that food product will enter the flow control chamber 20 from tube 12, be aligned therein using a system in which the pneumatic pistons 26 play a significant part, and that the water flow is controlled in flow chamber 20 by use of the control mechanism 22. It will further be appreciated that a rotating cutting knife is located between flow control chamber 20 and the outlet 36, the cutting knife being driven by motor 40. Finally, in connection with this initial illustration, it will be appreciated that water can be controlled to flow through pipe 29 from outlet 28 to inlet 34 and that, if desired, water can be bled from the system through outlet pipe 30 as controlled by valve 31.

Proceeding now to a description of FIG. 2, the major components of the present invention are described. A potato 11 is again shown in phantom., and details of the water flow control, alignment and knife drive systems are shown in this FIGURE. Flow control chamber 20 includes a central, generally cylindrical tube 50 which is suitably coupled to end 16 of tube 12 and extends through the end wall 51 of the flow control chamber 20. The axis of tube 50 generally coincides with that of the cutting knife to be employed in the system. Tube 50 terminates generally in the vicinity of a cutting knife 54 which, in the illustrated embodiment, is the tiered cutting knife described in the aforementioned Foster application. The drive system for knife 54 will be described in general form in a later section of this specification. Located between the inlet of tube 50 and knife 54 are two major components of the flow control section, i.e. the alignment fingers to be described next and the flow control system to be described thereafter in connection with FIGS. 2 and 3.

First, dealing with the alignment fingers, in the present invention a series of three such fingers 56 are used to assist in alignment of the potato 11 as it approaches the knife 54. Each alignment finger 56 is generally triangular in configuration and is arranged to pivot in a slot 57 in the wall of tube 50. Fingers 56 are pivotally coupled to tube 50 by pins 58 and are biased toward the axis of tube 50 by the pneumatic cylinders 26 previously described in connection with FIG. 1. A lip 60 is provided on the end of fingers 56 opposite from pins 58 and are arranged to catch on a portion of tube 50 so that the fingers are stopped upon full extension of the piston rods 62 extending from cylinders 26. Cylinders 26 are mounted on brackets 64 and suitable seals, such as O-rings 66, are employed to prevent leakage from chamber 20 as the piston rods 62 pass through the wall thereof. The internal ends of piston rods 62 are threaded, as at 68, to receive a clevis 70 which pivotally receives a plate 72 coupling the cylinder to the fingers 56. In our most preferred embodiment, the interior edges of fingers 56 are covered with a layer of Teflon® 74 to facilitate passage of the potato thereby and to prevent damage to the exterior of the potato.

In the illustration, three fingers 56, biased by three cylinders 26, are used in the flow control system for alignment purposes, but the number is not critical, and more than three could be employed if desired. The materials used for constructing fingers 56 can vary widely, but in our preferred embodiment they are made of nylon and are machined to match the inside contour of the tube 50. The fingers, again in the preferred embodiment, are about 1 inch wide and are arranged at 120° increments about the tube 50. The pressure exerted by fingers 56 can be controlled by adjustment of the pneumatic cylinders, and if desired, the Teflon® covering for the fingers can be made as an insert so that it can be replaced periodically. The fingers 56 minimize uncut potato rotation while centering the potato to the cutting knife 54. It will also be obvious to those familiar with this type of art that the alignment section allows for variable sized potatoes to engage the cutter blade on center, as is described in the aforementioned patent application and patents.

It is perhaps appropriate to again mention at this point that instead of the cutting knife shown in FIG. 2, the cutting knife of the original Samson et al. patent could be substituted therefor, as could the cutting knifes described in the aforementioned Julian and Covert et al. patents.

Proceeding next to a description of the water control system, control mechanism 22 is shown in FIGS. 2 and 3 to include a handwheel control knob 76 which, upon rotation, causes upward and downward movement of a threaded rod 78. Rod 78 extends generally vertically but is offset from the axis of chamber 20 and tube 50. Rod 78 extends through a cylindrical tube 80 into chamber 20 and leaks are prevented by suitable seals such as the O-rings 82 shown in FIG. 3. The interior end of rod 78 is screw fastened to a clevis 84 having a rod 86 extending between the sides thereof whereby, upon rotation of wheel 76, upward and downward movement of rod 86 is caused to occur.

A ring 90 surrounds tube 50 and a loop 92 extends radially therefrom on the side of ring 50 in the vicinity of rod 86. The loop 92 passes through clevis 84 with rod 86 passing through the loop so that, upon upward and downward movement of rod 86, ring 90 will be caused to rotate about fixed tube 50. A series of holes 94 are provided in tube 50 and a series of holes 96 are provided in ring 90, the holes being arranged to overlap one another when loop 92 is in a first location and to be only partially overlapped or not overlapped at all as rod 78 is moved upwardly or downwardly. It will thus be appreciated that water entering tube 50 can flow through holes 94 and 96 into the flow control chamber 20, depending on the movement of the flow control mechanism 22. It can also be appreciated by reference to FIG. 2 that water leaving tube 50 will pass into chamber 20 and exit therefrom through outlet 28 as previously described.

In connection with ring 90, a sliding fit around tube 50 is desired, but sealing between ring 90 and tube 50 is not essential. Since the object of the flow control mechanism 22 and the alignment fingers 56 is to cause a desired velocity of product travel toward the cutting knife, the flow control does not have to be precise, but it will need to be varied, depending upon the average size of the product in a particular lot being processed from time to time. In the present invention, product flow velocity and water pressure in the vicinity of the knife 54 is controlled solely by the amount that the respective holes 94 and 96 overlap with one another, since it is contemplated that the feed water flow from the pump (not shown) will remain generally constant. Furthermore, the relatively narrow alignment fingers 56 will have a minimal, if any, impact upon the water pressure which exists in the area of knife 54.

Several other of the components of the hydro-cutter of the present invention will now be described with further reference to FIG. 2. These relate primarily to the knife drive and the description will be in general terms as the drive system for knife 54 is generally the same as that shown in the aforementioned Samson et al. patent. The belt and motor are not shown in this FIGURE, but the pulley 46 which is coupled to belt 44 is shown attached to a rotating tube 100, which extends generally from the vicinity of pulley 46 toward knife 54. Bearings 102 are provided about tube 100 and have races mounted thereto and to a fixed exterior frame element 104 to permit tube 100 to rotate about a longitudinal axis and to drive cutting knife 54 in a manner which will be appreciated by those familiar with the prior art. The Samson et al. patent and the Foster application previously referred to are specifically incorporated herein by this reference for further details of the knife drive components.

It is also known that a stationary tube 108 can be provided within tube 100 for receiving product generated by passage of product through knife 54. Tube 108 is supported from a flange 110 bolted to frame elements of the cutter assembly 10 such as by bolts 112. Tube 108 has an outlet within outlet 36, the latter being bolted to the flow control section such as by bolts 115. From this general description, it can be appreciated that upon rotation of motor 40, tube 100 will be rotated at a desired speed for a particular potato cut, thereby driving knife 54 and generating a series of coils of helical potato product which are generally tightly coiled at the interior and more loosely coiled at the exterior as is generally illustrated by the schematic 120 in FIG. 2. That product, together with water which passes through the knife, passes through stationary tube 108 and enters outlet section 36.

Returning to FIG. 1, a cut-away section of outlet 36 shows in schematic form the product prepared in cutting apparatus 10 with the different diameter coils being separated longitudinally. In practice, the separation of such coils is an important part of the production of this type of product, and it is desired to maintain as many coils in a single strand as is possible for overall product appearance purposes. In the present invention. this is facilitated by returning at least a portion of the water which bypasses the cutting knife (by passing through holes 94 and 96 and out exit pipe 28) to the system through inlet 34. By control of the volume of water and the diameter of inlet 34, turbulence is created within section 36 of a magnitude to at least partially assist in the separation of the inner from the outer and intermediate coils, without destruction of the product. This will substantially reduce the amount of hand labor required for coil separation as the product continues to pass from outlet 36 onto draining conveyors (not shown) for subsequent processing and packaging. If it were desired to operate cutting 10 without return water flow, product emerging from stationary tube 108 would flow onto such a conveyor for separation using known techniques.

Typically, downstream processing operation include drying of the product and par frying of same prior to freezing for packaging and subsequent distribution. Further downstream processing operations could include the application of batter to the helical fries to create flavored or battered products which are also highly popular at the present time.

The present invention provides several unique advantages which have been described previously. The components are rugged and control of product flow and pressure into the cutting knife is achieved in a unique fashion, combining relief of water pressure using mechanism 22 and product alignment using alignment fingers 56. The system has much fewer moving parts than the plunger system described in the aforementioned Samson et al. patent, and permits an increase in productivity because there is no need for a plunger removal and product loading step. Product 11 can proceed serially through knife 54, thereby generating more product within a specified amount of manufacturing space. It is also believed that the energy costs involved in using water to feed product is less than that required for operating the plunger systems of the prior art and that product recovery will improve.

In our most preferred embodiment we have used a feeder tube 12 having a diameter beginning at 8 inches and dropping to 4 inches in about 3–5 feet and dropping further to 3 inches in another 2–3 feet. Water flow has been approximately 800 gallons/minute, with about 50% of that amount being bypassed as described above. The result is a water pressure at the knife of about 32–38 psi. We have increased the speed of our knife to 4,000–10,000 rpm, a substantially higher rate than with our prior mechanical system. The alignment fingers 56 were set at 40–60 psi to insure proper centering of the potatoes as they approach the center tube of the tiered knife 54, without damage to the skin of the potatoes. If we did not use the water bypass system, the velocity of the potatoes (and hence the production capacity) would be substantially reduced because of undesirable back pressure.

For a variety of reasons, it may be desirable to recirculate the water used in such systems and such recirculation, in whole or in part, can be accomplished by bleeding from the system water through outlet 30. Reuse of as much water as is possible, in compliance with all necessary discharge and sanitary codes, permits the water to be used for coil separation and results in a reduction in the amount of water which must be treated prior to discharge into sewers.

While the present invention has been described and illustrated in connection with a single preferred embodiment, the scope thereof is not to be limited by such description and illustration but is to be limited solely by the scope of the claims which follow. Certain equivalents will also appear to those skilled in the art, all of which are deemed to be within the scope of the present invention.

What is claimed is:

1. A method for cutting a food product comprising the steps of:

introducing the food product into a tapered tube with a water carrier, the tube having a gradually decreasing cross-sectional area;

passing the food product from the tapered tube into an elongate, generally cylindrical tube having an axis, aligning the food product, while it is in the generally cylindrical tube, with a cutting knife, the cutting knife being a rotating cutting knife adapted to cut helical strips from the food product and the knife is rotated when food product is passed therethrough;

passing the food product through the cutting knife to create a cut food product of a helical configuration and moving the cut food product into a chamber; and causing at least a portion of the carrier water to flow around the cutting knife and into the chamber.

2. The method of claim 1 wherein holes are provided in the cylindrical tube to allow the flow of water therefrom and the method further includes collecting the water flowing from the holes and causing it to flow into the chamber.

3. The method of claim 2 comprising the further step of controlling the quantity of carrier water flowing from the holes by selectively closing the holes.

4. The method of claim 2 wherein the alignment step is carried out by providing a plurality of alignment fingers which penetrate the wall of the cylindrical tube and are biased toward the axis thereof.

5. A device for cutting a food product comprising:

a feed tube which gradually decreases in cross-sectional area from an inlet to an outlet;

a water pump for introducing water and food product into the tube inlet;

a flow control system at the outlet of the tube including a generally cylindrical section having an inlet coupled to the tube outlet, an axis and an outlet;

a cutting knife located adjacent the section outlet, the cutting knife being a rotating cutting knife arranged to cut helical strips from the food product;

a chamber downstream of the knife; and water flow control means for causing at least a portion of the water entering the section to bypass the cutting knife and flow into the chamber.

6. The device of claim 5 further including means in the section for aligning the food product with the cutting knife.

7. The device of claim 5 wherein the aligning means comprise a plurality of alignment fingers pivotally and radially extending into the section and biased toward the axis of the section.

8. The device of claim 7 wherein the fingers are biased by pneumatic cylinders.

9. The device of claim 5 wherein the water flow control means comprises holes in the section and means for selectively opening and closing the holes.

10. The device of claim 9 wherein the opening and closing means comprises a ring surrounding the section, the ring also including holes, and means for rotating the ring about the section to selectively open and close the holes.

11. The device of claim 10 comprising a housing about the section to collect water.

* * * * *